US010325584B2

(12) United States Patent
Molinari et al.

(10) Patent No.: US 10,325,584 B2
(45) Date of Patent: Jun. 18, 2019

(54) ACTIVE NOISE CANCELLING DEVICE AND METHOD OF ACTIVELY CANCELLING ACOUSTIC NOISE

(71) Applicants: STMicroelectronics S.r.l., Agrate Brianza (IT); STMicroelectronics (Shenzhen) R&D Co. Ltd, Shenzhen (CN)

(72) Inventors: Luca Molinari, Piacenza (IT); Xi Chun Ma, Shenzhen (CN); Sandro Dalle Feste, Novaro (IT); Martino Zerbini, Abbiategrasso (IT)

(73) Assignees: STMicroelectronics S.r.l., Agrate Brianza (IT); STMicroelectronics (Shenzhen) R&D Co. Ltd, Shenzhen (CN)

( * ) Notice: Subject to any disclaimer, the term of this patent is extended or adjusted under 35 U.S.C. 154(b) by 0 days.

(21) Appl. No.: 14/863,228

(22) Filed: Sep. 23, 2015

(65) Prior Publication Data

US 2016/0171966 A1 Jun. 16, 2016

(30) Foreign Application Priority Data

Dec. 10, 2014 (IT) ..... TO2014A1028

(51) Int. Cl.
*H04R 1/10* (2006.01)
*G10K 11/178* (2006.01)

(52) U.S. Cl.
CPC ..... *G10K 11/178* (2013.01); *H04R 1/1083* (2013.01); *G10K 2210/1081* (2013.01); *G10K 2210/3028* (2013.01); *G10K 2210/3051* (2013.01); *H04R 2410/05* (2013.01); *H04R 2460/01* (2013.01)

(58) Field of Classification Search
CPC ..... H04R 3/04; H04R 1/1083; H04R 5/033; H04R 2460/01; G10K 11/178; G10K 11/175; G10L 2021/02165
USPC ..... 381/74, 101, 102, 103, 94.7, 73.1, 71.2, 381/71.6, 71.8, 71.14
See application file for complete search history.

(56) References Cited

U.S. PATENT DOCUMENTS 4,455,675 A 6/1984 Bose et al.
4,654,871 A 3/1987 Chaplin et al.
6,363,338 B1 3/2002 Ubale et al.
6,418,164 B1 * 7/2002 Endres ..... H04L 27/01 348/607
6,587,560 B1 * 7/2003 Scott ..... H04L 25/0266 379/413.02

(Continued)

OTHER PUBLICATIONS

Hurkat et al., "Analog Active Noise Canceling Headset Electronic Design Lab—EE 318," Department of Electrical Engineering, Indian Institute of Technology Bombay, May 3, 2011, 42 pages.

(Continued)

*Primary Examiner* — Alexander Jamal
(74) *Attorney, Agent, or Firm* — Seed IP Law Group LLP

(57) ABSTRACT

An active noise cancelling device including a sensor configured to convert acoustic signals into first audio signals and a speaker acoustically coupled to the sensor A control stage is configured to control the speaker based on the first audio signals to cause the speaker to produce cancelling acoustic waves that tend to suppress acoustic noise components in the acoustic signals. The control stage includes sigma-delta modulator digital filters.

18 Claims, 5 Drawing Sheets

(56) References Cited

U.S. PATENT DOCUMENTS

| | | | | |
|---|---|---|---|---|
| 6,691,082 | B1 * | 2/2004 | Aguilar | G10L 19/0208 704/219 |
| 8,848,935 | B1 | 9/2014 | Massie et al. | |
| 9,445,184 | B2 * | 9/2016 | Ring | H04R 1/1083 |
| 9,673,767 | B2 * | 6/2017 | Nielsen | H03G 3/20 |
| 2002/0067770 | A1 * | 6/2002 | Wu | H04B 14/06 375/247 |
| 2002/0105451 | A1 * | 8/2002 | Gulati | H03M 1/005 341/144 |
| 2002/0122478 | A1 * | 9/2002 | Hirasaka | G11B 20/10009 375/229 |
| 2005/0057383 | A1 * | 3/2005 | Chen | H03M 3/32 341/143 |
| 2008/0198050 | A1 * | 8/2008 | Akizuki | H03M 7/3015 341/136 |
| 2011/0116654 | A1 | 5/2011 | Chan et al. | |
| 2011/0130176 | A1 * | 6/2011 | Magrath | G10K 11/178 455/570 |
| 2011/0211707 | A1 | 9/2011 | Fuller | |
| 2012/0146824 | A1 * | 6/2012 | Silva | G01R 19/02 341/143 |
| 2014/0112492 | A1 | 4/2014 | Clemow | |
| 2014/0211953 | A1 | 7/2014 | Alderson et al. | |
| 2015/0006181 | A1 * | 1/2015 | Fan | H04R 1/08 704/270 |
| 2015/0214912 | A1 * | 7/2015 | Khenkin | H04R 3/06 381/102 |
| 2016/0192084 | A1 * | 6/2016 | Oliaei | H04R 19/005 367/135 |

OTHER PUBLICATIONS

Kuo et al., "Active Noise Control: A Tutorial Review," Proceedings of the IEEE, 87(6), Jun. 1999, pp. 943-973.

Reefman et al., "Signal processing for Direct Stream Digital, A tutorial for digital Sigma Delta modulation and 1-bit digital audio processing," Version 1.0, Dec. 18, 2002, 50 pages.

Reefman et al., "One-bit Audio: An Overview," Philips Research Laboratories, Prof. Holstlaan 4, 5656 AA Eindhoven, the Netherlands, Oct. 31, 2003, 39 pages.

Reiss et al., "Digital Audio Effects Applied Directly on a DSD Bitstream," Proceedings of the 7$^{th}$ International Conference on Digital Audio Effects (DAFX-04), Naples, Italy, Oct. 5-8, 2004, 6 pages.

Stewart et al., "Adaptive DSP Sigma Delta Algorithms and Architectures for Digital Communications (ADSPΣΔ)," Final Report on EPSRC Grant No. GR/K19921, Signal Processing Division, Department of Electric and Electronic Engineering, University of Strathclyde, Sep. 26, 1998, 9 pages.

* cited by examiner

ACTIVE NOISE CANCELLING DEVICE AND METHOD OF ACTIVELY CANCELLING ACOUSTIC NOISE

BACKGROUND

Technical Field

The present disclosure relates to an active noise cancelling device and to a method of actively cancelling acoustic noise.

Description of the Related Art

As is known, active noise cancelling is becoming more and more used to improve performance of audio systems, such as headphones, headsets, hearing aids, microphones and the like. This trend is also encouraged by recent developments in the field of microelectromechanical systems (MEMS), which provided extremely effective and sensitive devices, such as microphones and speakers, having the additional advantage of very low power consumption.

Active noise cancelling essentially consists of detecting acoustic noise produced by noise sources through a microphone at a given location, and using a feedback control based on microphone response to produce acoustic waves that tend to cancel noise by destructive interference in a band of interest (e.g., an audible band roughly comprised between 16 Hz and 16 kHz).

Most of known active noise cancelling systems are based on analog circuitry, namely analog filters, because it is normally possible to achieve lower phase delay compared to digital solutions. Filters are in fact included in the feedback control loop and phase delay is well-known to be a critical aspect for stability of feedback system.

Apart from a general trend toward digital solutions, analog active noise cancelling systems present some limitations in terms of poor flexibility, accuracy requirements of components, power consumption, area occupation and, in the end, cost. For example, it is quite difficult, or even impossible at all, sometimes, to provide for adjustable filter response and every component, including resistors, should be accurately trimmed to ensure expected performance. Thus, purely analog implementations are not ideally suited to improve miniaturization and flexibility of use.

On the other hand, known solutions that involve digital processing based on conventional chains of IIR filters may suffer from low sampling rate typical of audio systems (e.g., 48 kHz) and phase delay, which in turn may undermine stability, as already mentioned. Other active noise cancelling systems envisage higher sampling rates, but these solutions are normally demanding in terms of processing capability. Devices that meet processing requirements (e.g., Digital Signal Processors, DSP) are usually costly and power consuming.

BRIEF SUMMARY

An aim of the present disclosure is to provide an active noise cancelling device and a method of cancelling acoustic noise that allow some or all of the above described limitations to be overcome and, in particular, favors stability of digital active noise cancelling systems.

BRIEF DESCRIPTION OF THE SEVERAL VIEWS OF THE DRAWINGS

For a better understanding of the disclosure, an embodiment thereof will be now described, purely by way of non-limiting example and with reference to the attached drawings, wherein.

DETAILED DESCRIPTION

Figure 1:
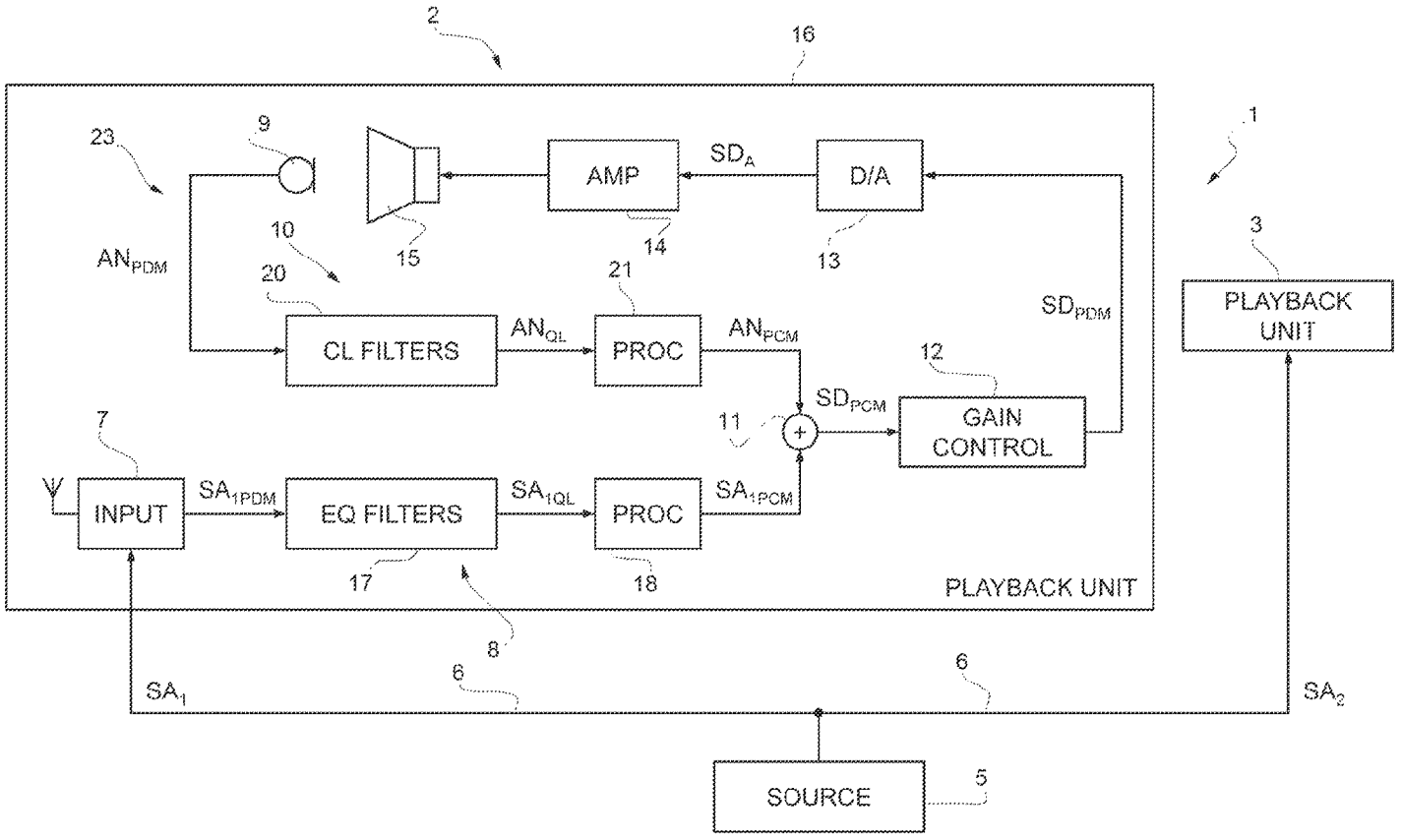
FIG. 1 is a block diagram of an audio system including a active noise cancelling device according to an embodiment of the present disclosure.

In FIG. 1, numeral 1 designates an audio system in accordance with an embodiment of the present disclosure and provided with an active noise cancelling function. The audio system 1 comprises a playback unit 2 and a playback unit 3, both coupled to a signal source 5 that is configured to respectively send audio signals $SA_1$, $SA_2$. The playback unit 2 and the playback unit 3 may be, for example, left and right earpieces of a headphone assembly. The signal source 5 may be for example, but not limited to, a tuner, a stereo or home theatre system, a cellphone or an audio file player, such as audio file player modules included in a smartphone, a tablet, a laptop or a personal computer.

In one embodiment, the audio signals $SA_1$, $SA_2$ supplied by the signal source 5 are oversampled digital signals in single-bit pulse density modulation (PDM) format (e.g., with a sampling frequency of 3 MHz) and the connection to the playback units 2, 3 is established through wires 6. In other embodiments, however, the first audio signals $SA_1$ and second audio signals $SA_2$ may be coded in pulse code modulation (PCM) format or may be analog signals. The audio signals $SA_1$, $SA_2$ may represent left audio signals and right channel audio signals, respectively.

In the embodiment of FIG. 1, the playback unit 2 and the playback unit 3 have the same structure and operation. Accordingly, reference will be made hereinafter to the playback unit 2 for the sake of simplicity. It is however understood that what will be described and illustrated is also applicable to the playback unit 3 and, if provided, to any further playback unit.

The playback unit 2 comprises an input interface 7, a signal processing stage 8, a microphone 9, an acoustic noise processing stage 10, a signal adder 11, a gain control stage 12, a D/A stage 13, an analog amplifier 14 and a loudspeaker 15, all enclosed within a casing 16.

Figure 2:
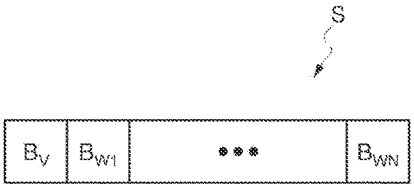
FIG. 2 is a schematic representation of a signal format used in the active noise cancelling device of FIG. 1.

The input interface 7 is coupled to the signal source for receiving the first audio signal $SA_1$ and is configured to convert the first audio signal $SA_1$ into a PDM audio signal $SA_{1PDM}$ in single-bit or multibit PDM format. In one embodiment (see FIG. 2), each sample S of a signal in multibit PDM format includes one value bit $B_V$ for the sample value (corresponding to the sample value of single-bit PDM format) and a fixed number N of weight bits $B_{W1}, \ldots, B_{WN}$ (e.g., five weight bits) defining a sample weight. The input interface 7 may be provided also with wireless communication capability, for receiving audio signals sent by a wireless signal source.

The signal processing stage 8 receives the PDM audio signal $SA_{1PDM}$ from the input interface 7 and supplies a PCM audio signal $SA_{1PCM}$ in PCM format to the signal adder 11.

Figure 3:
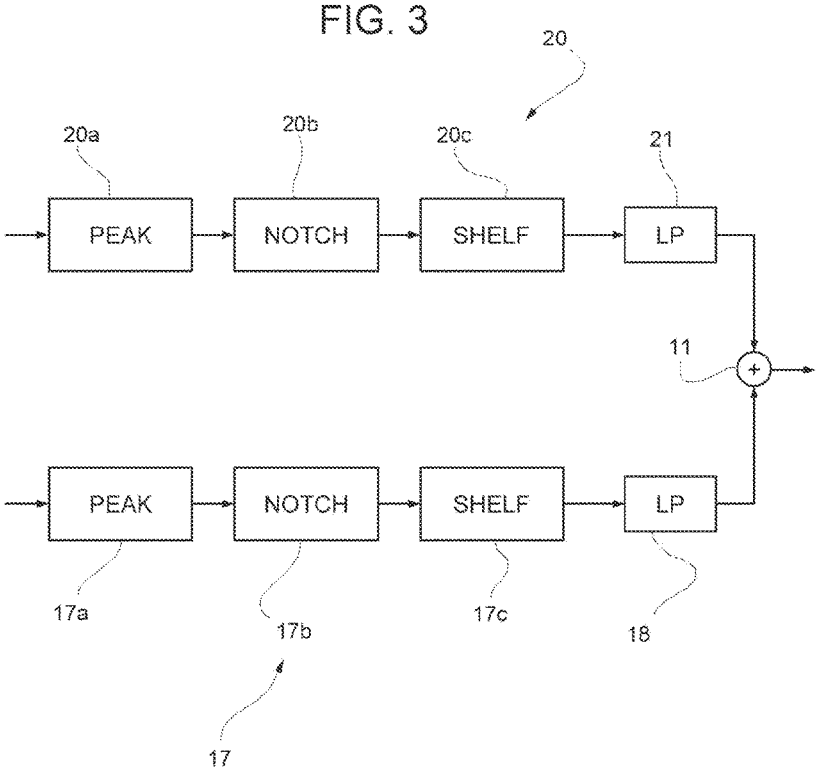
FIG. 3 is a more detailed block diagram of a portion of the active noise cancelling device of FIG. 1.

The signal processing stage 8 includes a set of equalization filters 17 and a processing module 18 with lowpass transfer function and a passband gain which, in one embodiment, may be unity. In one embodiment, the equalization filters 17 may include a cascade of a peak filter 17*a*, a notch filter 17*b* and a shelf filter 17*c*, as shown in FIG. 3. Other sets of filters may be however used, according to the need for specific applications.

The output of the equalization filters 17 is a quantized audio signal $SA_{1QL}$ in logarithmic multibit PDM format. As herein understood, a logarithmic multibit PDM format is a multibit PDM format in which the weight of each sample is represented in a logarithmic scale. In one embodiment, the weight of each sample is represented in base-2 logarithmic scale. In other words, the weight bits $B_{W1}, \ldots, B_{WN}$ of each sample represent the base-2 logarithm of the weight of the sample.

The processing module 18 applies a gain factor and converts the quantized audio signal $SA_{1QL}$ into a PCM audio signal $SA_{1PCM}$ in PCM format, which is fed to a first input of the signal adder 11. In one embodiment, the gain factor may be 1. The lowpass transfer function helps to keep the quantization noise low outside the audio band.

The microphone 9 is arranged to detect acoustic noise reaching the inside of the casing 16 from the surrounding environment. In one embodiment, the microphone 9 is a digital microphone and is configured to provide an acoustic noise signal $AN_{PDM}$ in oversampled PDM format, with the same sampling frequency as the audio signal $SA_1$ (here 3 MHz). In another embodiment, an assembly including analog microphone and a sigma-delta modulator could be provided in place of the digital microphone.

The acoustic noise processing stage 10 receives the acoustic noise signal $AN_{PDM}$ from the microphone 9 and supplies a filtered audio signal to the signal adder 11.

The acoustic noise processing stage 10 comprises a set of control loop filters 20 and a processing module 21 with lowpass transfer function and passband gain greater than unity. The control loop filters 20 are configured to suppress signal components corresponding to acoustic noise detected by the microphone 9 and may include a cascade of a peak filter 20*a*, a notch filter 20*b* and a shelf filter 20*c*, as shown in FIG. 3. Also in this case, other sets of filters may be used, according to the need for specific applications.

The output of the control loop filters 20 is a quantized acoustic noise signal $AN_{QL}$ in logarithmic multibit PDM format, wherein the weight of each sample is represented in the same logarithmic scale as in the quantized audio signal $SA_{1QL}$.

The processing module 21 applies a gain factor G0 (e.g., 100) in the respective passband and converts the quantized acoustic noise signal $AN_{QL}$ into a PCM acoustic noise signal $AN_{PCM}$ in PCM format, which is fed to a second input of the signal adder 11. Also in this case, the lowpass transfer function helps to keep the quantization noise low outside the audio band.

The signal adder 11 combines the PCM audio signal $SA_{1PCM}$ and the PCM acoustic noise signal $AN_{PCM}$, respectively received at its first and second input, into a PCM driving signal $SD_{PCM}$ in PCM format.

The gain control stage 12 includes a sigma-delta modulator configured the to convert the PCM driving signal $SD_{PCM}$ into a PDM driving signal $SD_{PDM}$ in single-bit or multibit PDM format and to apply a scaling function so that the PDM driving signal $SD_{PDM}$ complies with the input dynamic of the D/A stage 13, the analog amplifier 14 and the loudspeaker 15.

The D/A stage 13 includes a lowpass filter and is configured to convert the PDM driving signal $SD_{PDM}$ into an analog driving signal $SD_A$, which is supplied to the loudspeaker 15 through the amplifier 14. In one embodiment, the D/A stage 13 may be integrated in the gain control stage 12, e.g., where a class D amplifier is used.

The microphone 9, the acoustic noise processing stage 10, the gain control stage 12, the D/A stage 13, the analog amplifier 14 and the loudspeaker 15 form an active noise cancelling device 23 that is configured to attenuate acoustic noise within the casing 16 of the playback unit 2.

Acoustic noise is collected by the microphone 9 and converted by the control loop filters 20 into a cancelling component of the driving PDM driving signal $SD_{PDM}$ that, after further conversion into the analog driving signal $SD_A$, causes the loudspeaker 15 to produce cancelling acoustic wave and suppress acoustic noise by destructive interference.

The control loop filters 20 may have any suitable transfer function that effectively achieves noise cancelling and, in one embodiment, they include the peak filter 20*a*, the notch filter 20*b* and the shelf filter 20*c*, as already mentioned.

At least one and, in one embodiment, all of the control loop filters 20 are sigma-delta modulator digital filters, exploiting base-2 logarithmic quantization.

Figure 4:
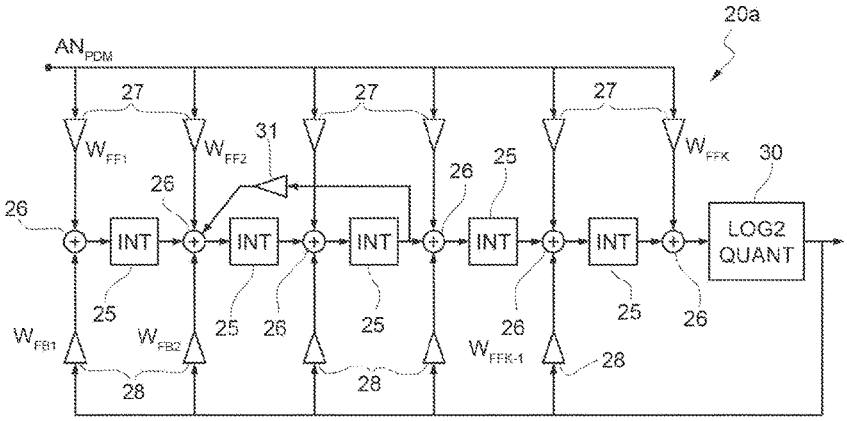
FIG. 4 is a detailed block diagram of a first filter of the active noise cancelling device of FIG. 1.

The control loop filters 20 may be in the Cascade-of-Integrators FeedBack form (CIFB), which is illustrated by way of example in FIG. 4 for the peak filter 20*a*. However, other sigma-delta modulators, with different structure, could be used.

The CIFB peak filter 20*a* comprises a plurality of integrator modules 25, a plurality of adder modules 26, a plurality of forward filter modules 27, a plurality of feedback filter modules 28 and a logarithmic quantizer 30.

The adder modules 26 and the integrator modules 25 are arranged alternated to form a cascade in which each adder module 26 feeds into a respective subsequent integrator module 25 and each integrator module 25 feeds into a respective subsequent adder module 26. One more adder module 26 is located between the most downstream integrator module 25 and the logarithmic quantizer 30.

Each forward filter module 27 is configured to apply a respective forward filter coefficient $W_{FF1}, W_{FF2}, \ldots, W_{FFK}$ to an input signal, i.e., the acoustic noise signal $AN_{PDM}$ for the peak filter 20*a*, and to supply the resulting signal to a first input of a respective one of the adder modules 26.

Each feedback filter module 28 is configured to apply a respective feedback filter coefficient $W_{FB1}, W_{FB2}, \ldots, W_{FBK-1}$ to an output signal of the logarithmic quantizer 30 and to supply the resulting signal to a second input of a respective one of the adder modules 26, except the adder module 26 adjacent to the logarithmic quantizer 30.

In one embodiment, the forward filter coefficient $W_{FF1}, W_{FF2}, \ldots, W_{FFK}$ and the feedback filter coefficient $W_{FB1}, W_{FB2}, \ldots, W_{FBK-1}$ are programmable and a transfer function of the peak filter 20*a* has a zero at the Nyquist frequency, that improves attenuation of out-of-band quantization noise.

In one embodiment, the peak filter 20*a* includes also an internal feedback filter module 31, that applies an internal feedback filter coefficient to the output of one of the integrator modules 25 and supplies the resulting signal to a third input of one of the upstream adder modules 26.

The logarithmic quantizer 30 quantizes the output signal of the adjacent adder module 26 using a logarithmic scale. In one embodiment, the logarithmic quantizer 30 is a base-2 logarithmic quantizer and provides a multibit PDM signal ranging in module from $2^{-M}$ to $2^{M}$, M being the number of bits for the weight of each sample.

The other control loop filters 20 (the notch filter 20*b* and the shelf filter 20*c* in the embodiment described) have the same CIFB structure, possibly with a different number of integrators in the cascade and filter coefficient selected to implement the desired filtering functions.

Figure 5:
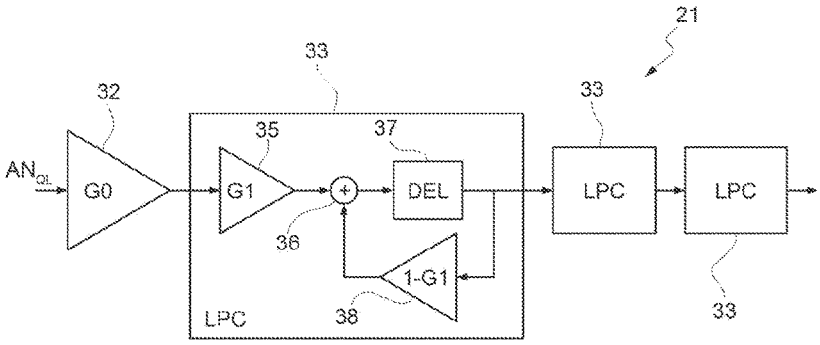
FIG. 5 is a detailed block diagram of a second filter of the active noise cancelling device of FIG. 1.

An example of the processing module 21 is illustrated in FIG. 5 and comprises a gain stage 32 and a plurality of lowpass filter cells 33 in cascade. The gain stage 32 is configured to apply the gain factor G0 to an input signal of the processing module 21, i.e., the quantized acoustic noise signal $AN_{QL}$ received from the control loop filters 20. The lowpass filter cells 33 in one embodiment are equal to one another and have unity gain. The structure of one of the lowpass filter cells 33 is shown in FIG. 5. In one embodiment, the lowpass filter cells 33 comprise each a first gain module 35, configured to apply a gain factor G1 to an input signal of the lowpass filter cells 33; an adder module 36; a delay module 37; and a second gain module 38, configured to apply a gain factor 1-G1 to an output signal of the delay module 37. The adder module 36 combines output signals of the first gain module 35 and of the second gain module 38 and supplies a resulting signal to the delay module 37, that is configured to apply a unity step delay (i.e., a delay of one sample).

In one embodiment, the equalization filters 17 include sigma-delta modulator digital filters in CIFB form. Thus, the equalization filters 17 have the general structure described with reference to FIG. 4 for the peak filter 20*a*, possibly with a different number of integrators and different filter coefficients. However, other sigma-delta modulators, with different structure, could be used.

Likewise, the structure of the processing module 18 is similar to the structure of the lowpass amplifier filter 20, except in that the overall gain is unity and a different number of lowpass filter cells may be included.

Figure 6:
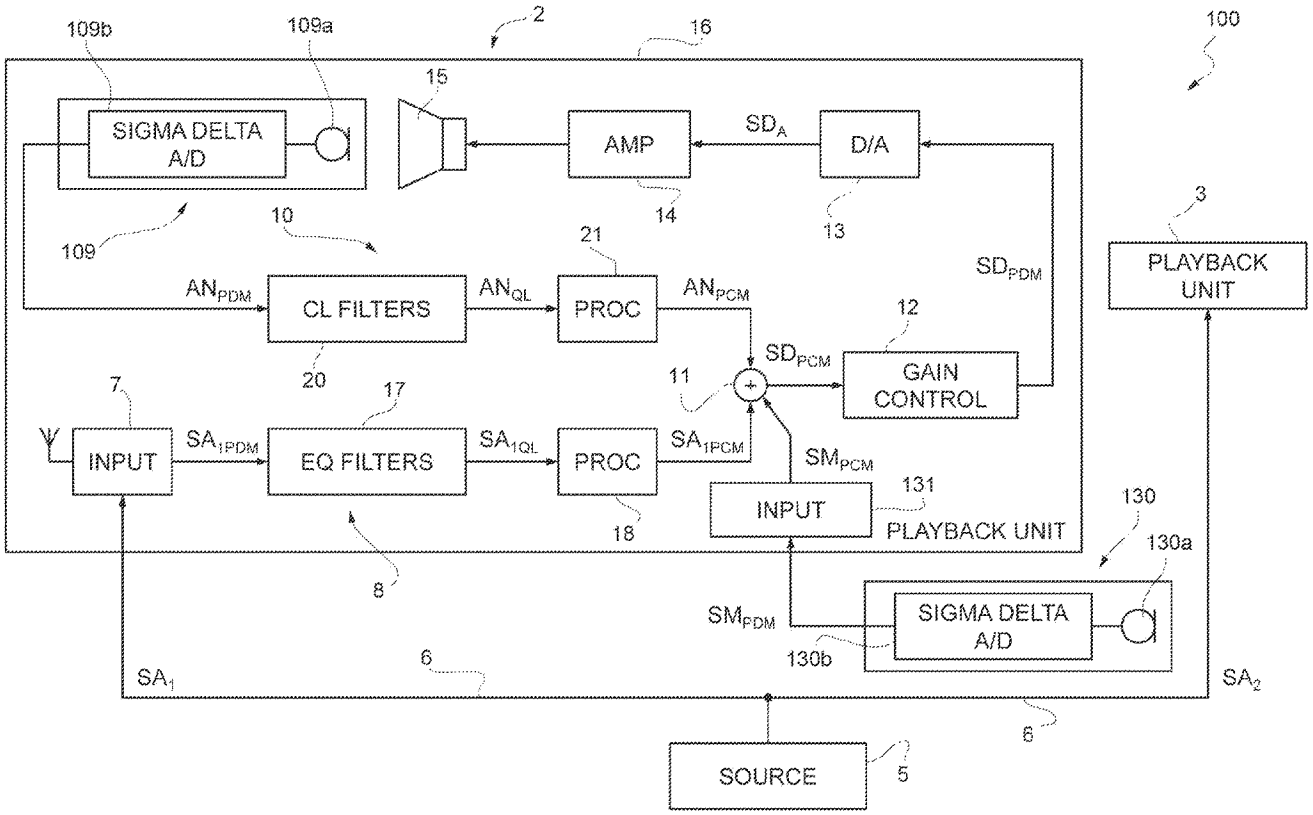
FIG. 6 is a block diagram of an audio system including a active noise cancelling device according to another embodiment of the present disclosure.

According to another embodiment, illustrated in FIG. 6, an audio system 100 has substantially the structure of the audio system of FIG. 1 and includes an acoustic sensor 109 in place of the digital MEMS microphone 9. Moreover, the audio system 100 comprises an additional forward acoustic sensor 130.

The acoustic sensor 109 comprises an analog microphone 109*a* and a sigma-delta A/D converter 109*b* coupled to the microphone 109*a*. The sigma-delta A/D converter 109*b* is configured to receive an analog audio signal from the microphone 109*a* and to convert the analog audio signal into the acoustic noise signal $AN_{PDM}$ in oversampled multibit PDM format.

The additional forward acoustic sensor 130 comprises an analog microphone 130*a* and a sigma-delta ND converter 130*b* coupled to the microphone 130*a*. The sigma-delta A/D converter 130*b* is configured to receive an analog audio signal from the microphone 130*a* and to convert the analog audio signal into a PDM microphone signal $SM_{PDM}$ in oversampled PDM format. An input interface 131 of the playback unit 2 receives the PDM microphone signal $SM_{PDM}$ and converts it into a PCM microphone signal $SM_{PCM}$, which is then supplied to a third input of the adder module. The input module 131 may include filters and a processing module, similar to the filters and processing modules of the signal processing stage 8 and of the acoustic noise processing stage 10.

A MEMS digital microphone may be used in place of the additional forward acoustic sensor 130 in another embodiment.

The solution described above entails several advantages.

First, the active noise cancelling function is based on PDM processing and sigma-delta modulator digital filters. On the one side, PDM systems usually exploit a high sampling frequency to produce an oversampled bitstream (3 MHz in the example described). On account of the high sample frequency, latency and delays in the active noise cancelling loop are low, to the benefit of the phase margin, and, accordingly, stability requirements may be easily met. Active noise cancelling function may be thus implemented by reliable fully digital systems.

Figure 7:
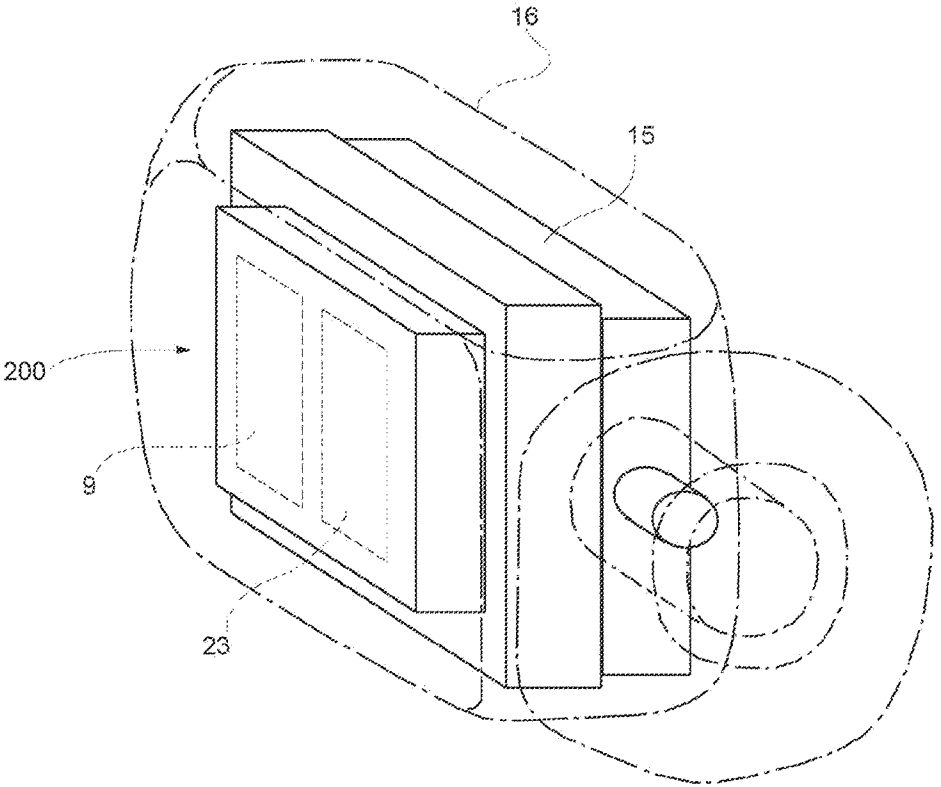
FIG. 7 is perspective view of a component of the audio system of FIG. 1.

On the other hand, for a given performance level, sigma-delta modulator digital filters have simple structure that is much less demanding in terms of area occupation and power consumption compared to Digital Signal Processors. Thus, also miniaturization is favored to the extent that it is possible to design even in-ear headphones or hearing aids provided with respective active noise cancelling loops and remote processing is not required. For example, see FIG. 7, a single package 200 for in-ear headphones may include the MEMS microphone 9 and control circuitry comprising the active noise cancelling device 23, thus reducing the need for wiring. In this case, the casing 16 is configured to be inserted directly in a user's ear passage and the package 200 is enclosed within the casing 16 together with the loudspeaker 15. Also wireless in-ear headphones may be obtained.

Multibit PDM coding with a single bit for the sample value and a plurality of bits for the sample weight help to achieve extremely simplified structure. In fact, with this signal format shift registers are enough to implement multipliers, e.g., to apply forward and feedback filter coefficients of the control loop filters.

The sigma-delta modulator digital filters are also easily reconfigurable, since it is possible to adjust the forward and feedback filter coefficients by writing registers via software. Therefore, filter trimming is not as critical as with analog solutions.

Other advantages are associated with the use of a logarithmic quantizer in the control loop filters, especially a base-2 logarithmic quantizer. Indeed, logarithmic quantizer not only allows a broader dynamic range, but also contributes to reduce quantization noise (out of band noise). Quantization error is in fact correlated to the sample weight, so that the effect on sample having lower absolute value is mitigated.

Base-2 quantization puts the sampled signals already in the appropriate multibit PDM format, thereby simplifying processing.

Amplification of out-of-band noise present in the PDM signals is avoided by the use of low pass stages in combination with amplification gain.

Adding a zero at the Nyquist frequency in at least one of the control loop filters 20 contributes to reduce out-of-band noise and to avoid instability of the structure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An active noise cancelling device, comprising:

a sensor configured to detect acoustic signals and to convert the detected acoustic signals into first audio signals;

a speaker acoustically coupled to the sensor; and a control stage configured to control the speaker based on the first audio signals to produce cancelling acoustic waves that tend to suppress acoustic noise components in the acoustic signals, the control stage including sigma-delta modulator digital filters configured to suppress signal components of the first audio signals corresponding to the acoustic noise components in the acoustic signals detected by the sensor, the control stage further including a processing module including a gain stage configured to apply a gain to an input signal received from the sigma-delta modulator digital filters and to provide an output based on the input signal to a plurality of low pass filter circuits coupled in series, wherein each sigma-delta modulator digital filter has a cascade-of-integrators structure coupled in series with a quantizer to generate a quantized acoustic noise signal in logarithmic multibit format, the cascade-of-integrators structure of each sigma-delta modulator digital filter including:

a plurality of adder modules including a first adder module and a final adder module coupled to the quantizer;

a plurality of integrator modules alternately coupled in series with the plurality of adder modules between the first and final adder modules; and an internal feedback filter module coupled to provide a feedback signal from an output of one of the plurality of integrator modules to an input of one of the plurality of adder modules.

2. The device according to claim 1, wherein the sigma-delta modulator digital filters have a transfer function configured to cancel acoustic noise at the sensor.

3. The device according to claim 2, wherein the sigma-delta modulator digital filters include a peak filter, a notch filter and a shelf filter.

4. The device according to claim 1, wherein the quantizer comprises a logarithmic quantizers.

5. The device according to claim 1, wherein at least one of the sigma-delta modulator digital filters has a zero at the Nyquist frequency.

6. The device according to claim 1, wherein the first audio signals are in multibit PDM format.

7. The device according to claim 1, wherein the control stage comprises a processing module configured to convert a second audio signal received from the sigma-delta modulator digital filters into a third audio signal in PCM format.

8. The device according to claim 7, wherein the processing module has a low-pass transfer function and a bandpass gain greater than unity.

9. The device according to claim 8, comprising a signal processing stage configured to receive an input signal and to convert the input signal into a fourth audio signal in PCM format.

10. The device according to claim 9, wherein the signal processing stage comprises further sigma-delta modulator digital filters.

11. The device according to claim 10, comprising a driving stage configured to drive the speaker based on a combination of the third audio signal and fourth audio signal.

12. An electronic device, comprising:

at least one playback unit, each playback unit including, a casing;

an acoustic sensor that in operation converts detected acoustic signals into first audio signals;

a speaker acoustically coupled to the acoustic sensor; and control stage circuitry being housed within the casing and electrically coupled to the acoustic sensor and the speaker, the control stage circuitry including a sigma-delta modulator that in operation filters the first audio signals to suppress signal components of the first audio signals corresponding to the acoustic noise components in the detected acoustic signals, and the control stage circuitry in operation controlling the speaker based on the filtered first audio signals to generate cancelling acoustic waves that reduce acoustic noise components in the detected acoustic signals, the control stage circuitry including a sigma-delta modulator digital filter having a cascade-of-integrators filter including a plurality of adders and a plurality of integrators coupled alternately in series between a first one of the plurality of adders and a final one of the plurality of adders, and including a logarithmic quantization circuit coupled to the final one of the plurality of adders, and the control stage further configured to receive a filtered signal from the sigma-delta modulator digital filter and to apply a gain to and to low pass filter the filtered signal to generate an acoustic noise signal that is added to an input audio signal provided to the speaker.

13. The electronic device according to claim 12, wherein each playback unit is an earpiece.

14. The electronic device of claim 12, wherein the at least one playback unit comprises two playback units that form left and right earpieces contained in a headphone assembly.

15. A method for active noise cancelling, comprising:

detecting acoustic signals present in a spatial region, the acoustic signals including acoustic noise components;

converting the detected acoustic signals present in the spatial region into first electrical audio signals having a multibit pulse density modulation coding with a single bit for a sample value and a plurality of bits for sample weight;

sigma-delta modulator filtering through a cascade-of-integrators feedback structure the first electrical audio signals to attenuate signal components of the first electrical audio signals that correspond to the acoustic noise components of the detected acoustic signal;

logarithmically quantizing the filtered first electrical audio signals to generate a quantized acoustic noise signal having a multibit pulse density format;

applying a gain to the quantized acoustic noise signal to provide an amplified quantized acoustic noise signal;

low pass filtering the amplified quantized acoustic noise signal to generate a low pass filtered amplified quantized acoustic noise signal;

generating acoustic noise cancelling signals based on the low pass filtered amplified quantized acoustic noise signal; and producing cancelling acoustic waves in the first spatial region based on the generated acoustic noise cancelling signals, the produced cancelling acoustic waves attenuating the acoustic noise components of the detected acoustic signals.

16. The method of claim 15, wherein sigma-delta modulator filtering the first electrical audio signals and generating acoustic noise cancelling signals comprise peak filtering followed by notch filtering followed by shelf filtering of the detected acoustic signals.

17. The method of claim 16, wherein producing cancelling acoustic waves comprises controlling a speaker based on the generated acoustic noise cancelling signals.

18. The method of claim 15, wherein converting the detected acoustic signals present in the spatial region into first electrical audio signals comprises converting acoustic signals present in an ear of a person into the first electrical audio signals.

* * * * *